US005996652A

United States Patent [19]

Schromm

[11] Patent Number: 5,996,652

[45] Date of Patent: Dec. 7, 1999

[54] FILLING FLUENT FOODSTUFFS INTO CONTAINERS

[75] Inventor: Karl Schromm, Schwäbish Hall, Germany

[73] Assignee: Benhil Gasti Verpackungsmaschinen GmbH, Neuss, Germany

[21] Appl. No.: 09/135,958

[22] Filed: Aug. 18, 1998

[30] Foreign Application Priority Data

Aug. 18, 1997 [DE] Germany ..... 197 35 619
Aug. 18, 1997 [DE] Germany ..... 197 35 621

[51] Int. Cl.[6] ..... B65B 43/42

[52] U.S. Cl. ..... 141/172; 141/129; 141/9; 141/258; 141/235

[58] Field of Search ..... 141/9, 18, 89, 141/172, 99, 104, 105, 168, 183, 184, 185, 129, 258, 235

[56] References Cited

U.S. PATENT DOCUMENTS

| | | | |
|---|---|---|---|
| 3,172,434 | 3/1965 | Boucher . | |
| 3,390,891 | 7/1968 | Stichhan . | |
| 4,341,329 | 7/1982 | Kuemmerer et al. | 141/235 |
| 4,666,723 | 5/1987 | Invernizzi et al. | 141/9 |
| 4,729,206 | 3/1988 | Francis . | |
| 5,019,127 | 5/1991 | Bohm et al. | 141/258 |
| 5,095,955 | 3/1992 | Barnewitz et al. | 141/172 |
| 5,529,099 | 6/1996 | Janek et al. | 141/129 |

FOREIGN PATENT DOCUMENTS

| | | |
|---|---|---|
| 0 365 569 | 2/1990 | European Pat. Off. . |
| 0 678 245 A1 | 10/1995 | European Pat. Off. . |
| 3718950 | 12/1988 | Germany . |
| 42 26 566 | 2/1994 | Germany . |
| 295 12 257 | 11/1995 | Germany . |

*Primary Examiner*—Henry J. Recla
*Assistant Examiner*—Khoa Huynh
*Attorney, Agent, or Firm*—Herbert Dubno Andrew Wilford

[57] ABSTRACT

An apparatus for filling cups has a conveyor for displacing the cups in a horizontal transport direction stepwise along a horizontal transport path and at least two dosing units spaced in the transport direction from each other above the path and each including a supply of a fluent material and valve and pump means for ejecting doses of the material. A manifold includes a pair of intake conduits each extending generally in the horizontal transport direction and each connected to a respective one of the dosing units for receiving the material doses therefrom and a distributor body between the dosing units, formed with a pair of grooves each connected to a respective one of the tubes, and forming a pair of outlet passages open vertically downward toward the path so that material fed generally horizontally from the dosing units to the body issues downward from the body. A lifter ring below the path, underneath the body, and displaceable between a lower position clear of the cups and an upper position can raise a one of the cups into engagement with the body. This lifter ring and the cup held thereby are also rotated as the material issues from the body.

15 Claims, 8 Drawing Sheets

FILLING FLUENT FOODSTUFFS INTO CONTAINERS

FIELD OF THE INVENTION

The present invention relates to a system for filling fluent foodstuffs into containers. More particularly this invention concerns a method of and apparatus for filling a plurality of different food stuffs into the same or different cups.

BACKGROUND OF THE INVENTION

In the packaging of yoghurt, pudding, and similar foodstuffs it is standard to inject a single dose, normally about ounces, of the foodstuff into a disposable cup carried passed the dosing machine on a conveyor that operates stepwise. After the cup is filled, a foil is welded to its rim and a cap is applied. In the simplest system a row of nozzles extends transversely to the conveyor which moves transverse rows of the cups stepwise past the nozzles. At each step each nozzle deposits a dose of the food stuff into the underlying cup, and the cups may be raised up from their respective seats in the conveyor to receive the respective doses.

German utility model 295 12 257 describes a system where each nozzle has a pair of passages to which are fed different foodstuffs, for instance vanilla and chocolate pudding. In addition the individual cup lifters are constructed so that they can rotate the cups as they are filled, creating an attractive swirling pattern and nice mix of the ingredients. In this system a complex gripper arrangement is used to hold the bases of the cups. Each nozzle has a pair of downwardly opening outlet passages, one of which is fed from a supply directly overhead and the other of which is fed from another supply via a horizontal connecting conduit.

The system of German patent 4,226,566 of Janek describes a system where the cups of each row are filled with different foodstuffs so that they can be packaged directly as an assortment, with the cups connected together by frangible webs. In this arrangement the cups pass through eight abreast and four different sources are each connected to two of the nozzles, so that it is possible to vary the mix of the assortments by filling a cup with one flavor and the cup following it with another. Such an apparatus is quite complex and is only really adapted to its one purpose.

OBJECTS OF THE INVENTION

It is therefore an object of the present invention to provide an improved container-filling system.

Another object is the provision of such an improved container-filling system which overcomes the above-given disadvantages, that is which can be used for filling containers each with a single fluent foodstuff or with two or more such foodstuffs and that can easily be switched between these two types of operation.

A further object is to provide a particularly neat and simple container filling method.

SUMMARY OF THE INVENTION

An apparatus for filling cups has according to the invention a conveyor for displacing the cups in a horizontal transport direction stepwise along a horizontal transport path and at least two dosing units spaced in the transport direction from each other above the path and each including a supply of a fluent material and valve and pump means for ejecting doses of the material. A manifold includes a pair of intake conduits each extending generally in the horizontal transport direction and each connected to a respective one of the dosing units for receiving the material doses therefrom and a distributor body between the dosing units, formed with a pair of grooves each connected to a respective one of the tubes, and forming a pair of outlet passages open vertically downward toward the path so that material fed generally horizontally from the dosing units to the body issues downward from the body. A lifter below the path, underneath the body, and displaceable between a lower position clear of the cups and an upper position can raise a one of the cups into engagement with the body. This lifter and the cup held thereby are also rotated as the material issues from the body.

Thus it is possible to use the apparatus according to the invention for a simple single-dose filling system, in which case the manifold arrangement is done away with, or as a multiple- or mixed-dose arrangement. The machine can easily be converted between these two modes of operation.

In accordance with the invention each intake conduit has an upwardly open cup-shaped intake end fitting complementarily over the respective dosing unit and provided with a connecting rim and an insert in the intake end formed with a passage communicating with the respective dosing unit. The tubes extend from the intake end and communicating with the passage of the insert. The dosing unit and rim have releasable interengaging formations, normally a bayonet coupling. This makes it relatively easy to mount the manifold of the invention onto the one-shot dosers of a standard machine, converting it to a more complex machine.

Each tube extends horizontally and downward from the respective dosing unit to the distributor body for easiest flow of the normally viscous material. In addition the grooves are circumferential and vertically offset from each other. The outlet passages run vertically downward from the respective grooves. Each manifold further includes respective pistons displaceable in the passages between positions blocking the passages and positions permitting flow through the passages. The pistons have stems projecting vertically out of the distributor body and lower ends sealingly engageable with the respective passages.

The cup-filling apparatus wherein each dosing unit includes a respective servomotor controlling the respective valve and pump means. The apparatus further has according to the invention a central controller connected to all the servomotors for controlling all the servomotors. This controller can operate according to a program to fill the various cups with different mixes, and can even vary the way the lifters move to vary the way the mixes are created in the cups.

For an exact positioning of the cups during filling, the apparatus of the invention uses lifter rings that are shaped complementary to the cup. Each such lifter ring has a centrally raised floor and can be formed with an inwardly projecting annular bead.

The ring can have a frustoconical upwardly flared upper portion forming a very small angle with the cup. Means is normally provided for rotating the lifter ring and the cup held thereby as the material issues from the body.

The cup-filling method according to the invention method comprising the steps of positioning each of the cups in a respective seat in a conveyor plate, conveying the plates with the cups in a horizontal transport direction stepwise along a horizontal transport path underneath a dosing unit and above a holder, and raising the holder each time a cup arrives below the dosing unit while engaging the holder around the cup to lift the cup and press it upward against the dosing unit and force it downward into the holder. When a cup has been raised up against the dosing unit, a dose of a fluent material is ejected downward from the dosing unit into the raised cup, and, after ejection of the dose into the cup, the holder is lowered below the transport plate to strip the cup from the holder and leave the lowered cup in the seat of the transport plate. The cups are normally made of plastic with a frustoconically upwardly flared side wall, a planar and outwardly directed rim, and a basically flat floor. The transport plates are formed with circular seat holes and the cups rest in them with their rims sitting on the top face of the plate.

The cup in accordance with the invention has a resiliently deformable wall and the holder is engaged with the wall. This ensures solid holding of the cup during filling so that it can, if desired, be rotated about a vertical axis, while still making it easy to strip the cup from the holder ring after filling.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
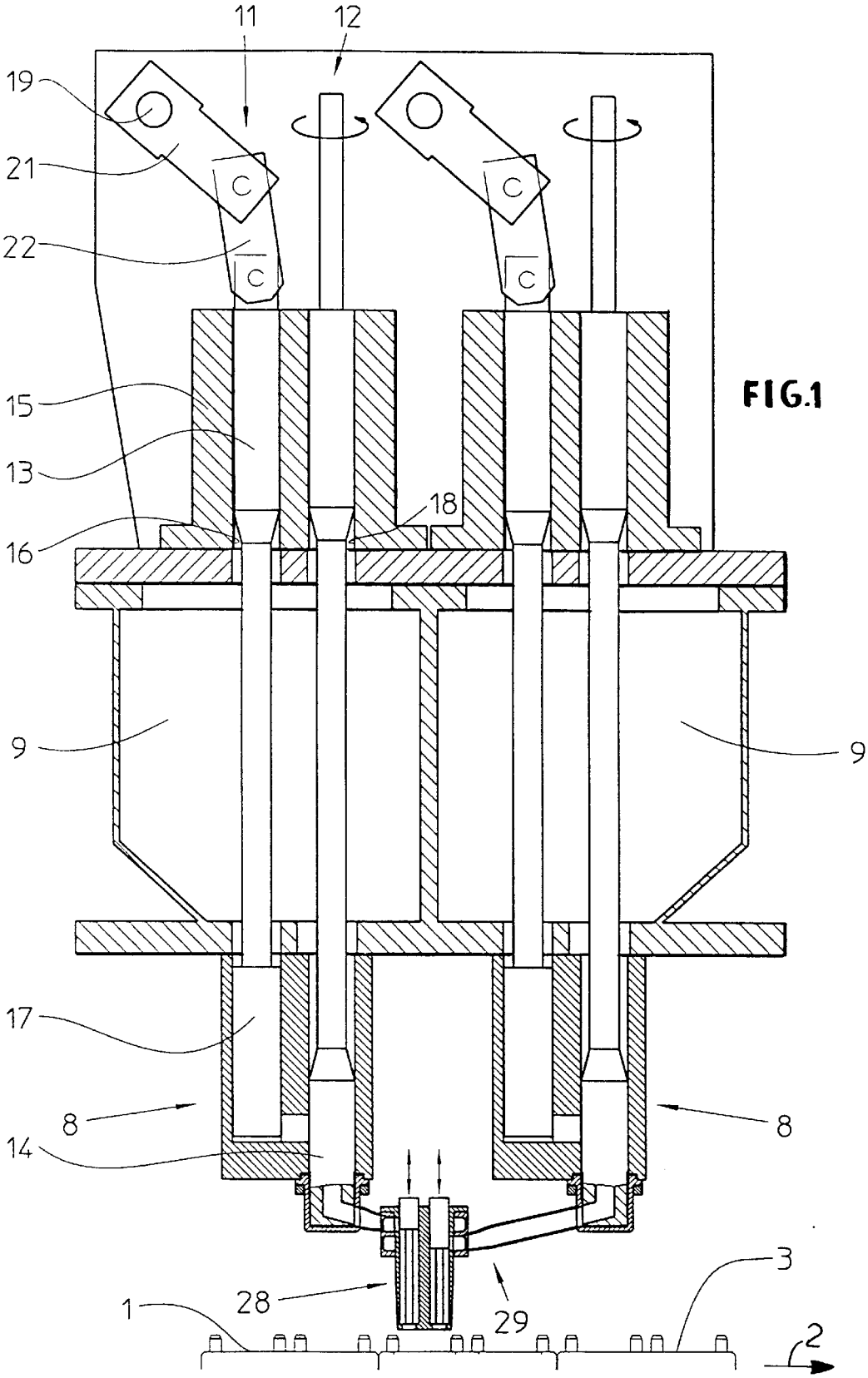
FIG. 1 is a vertical section seen from the side of a filling and dosing unit.

As seen in FIGS. 1–4 a conveyor is comprised of a series of transport plates 1 moved stepwise in a transport direction 2 and each having four seats 3 for individual containers, here cups 4, each made of plastic with a basically frustoconical side wall terminating at an annular and planar rim 7 that normally sits on the plate 1. Respective lifters 5 have cup holders 6 that can engage the cups 4 to raise them out of the seats 3.

The cups 4 are moved under individual dosers 8 each associated with a supply 9 holding a respective product, for instance yoghurt or pudding. In a single-product system, both supplies can be filled with the same product and can be fitted with a single-passage dispenser nozzle such as shown at 10 in FIG. 3. Thus this arrangement can be used for the simplest possible filling/packaging system and can even be employed for dispensing juices or the like.

Figure 2:
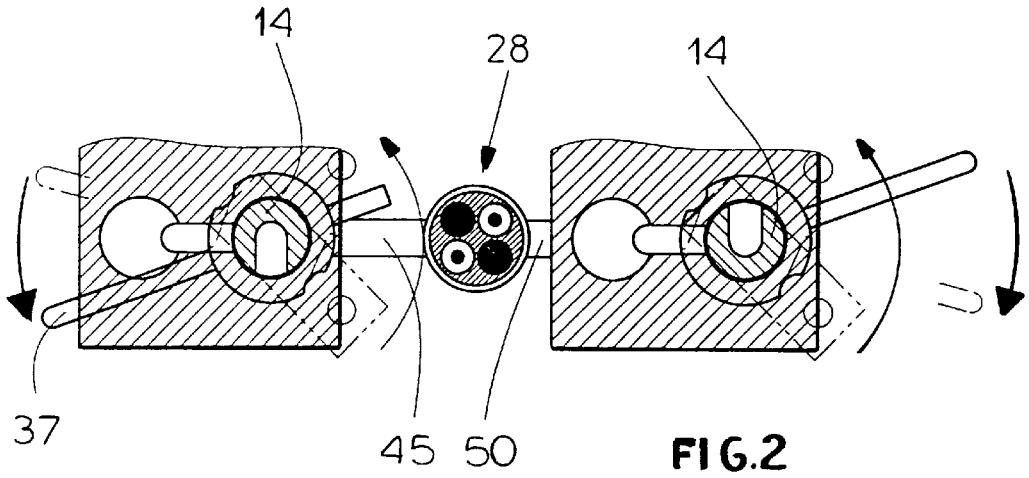
FIG. 2 is a horizontal section through the structure of FIG. 1.
Figure 5:
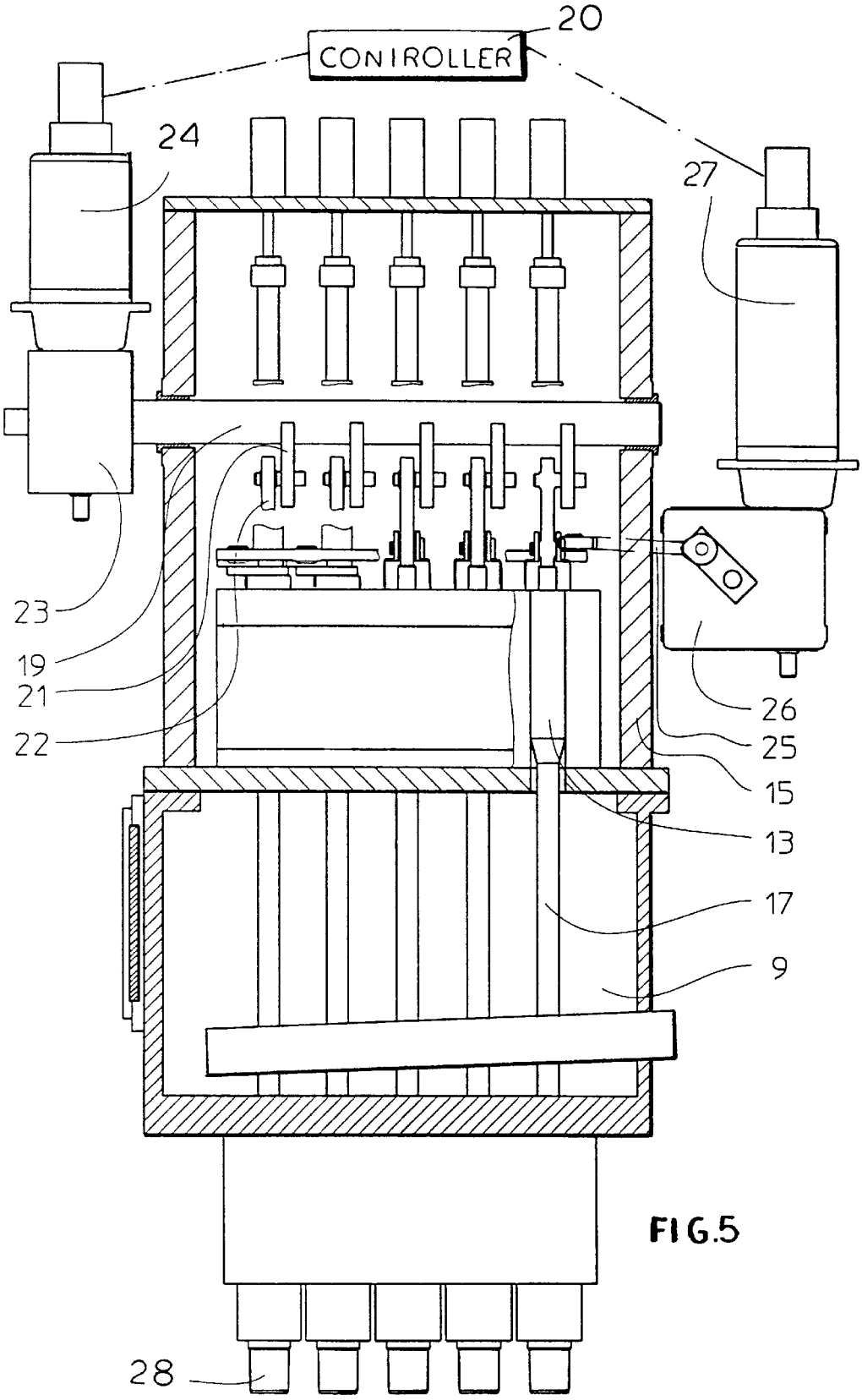
FIG. 5 is a partly schematic end view of the filling and dosing unit showing its drives.

Associated with each doser 8 is a pump drive 11 having a piston 13 and a rotary valve 12 having a valve member 14 (see FIG. 2). The pump drive 11 has a dosing housing 15 formed with a bore 16 in which is reciprocal a dosing piston 17 and as also shown in FIG. 5 an oscillating drive shaft 19 carrying a crank 21 connected via a link 22 to the piston 13. A motor 24 is connected via a transmission 23 to the shaft 19 to oscillate it back and forth. The valve 12 has a bore 18 in which the valve member 14 rotates. Together the pump 11 and valve 12 are capable of extracting an exactly measured dose of the fluent material from the respective reservoir or supply 9 and expelling it from the doser 8. As also shown in FIG. 5, the rods 14 are oscillated about vertical axes by a motor 27 connected to them through a link 25 and transmission 26. A controller 20 connected to the motors 24 and 27 operates them in accordance with a program.

Figure 3:
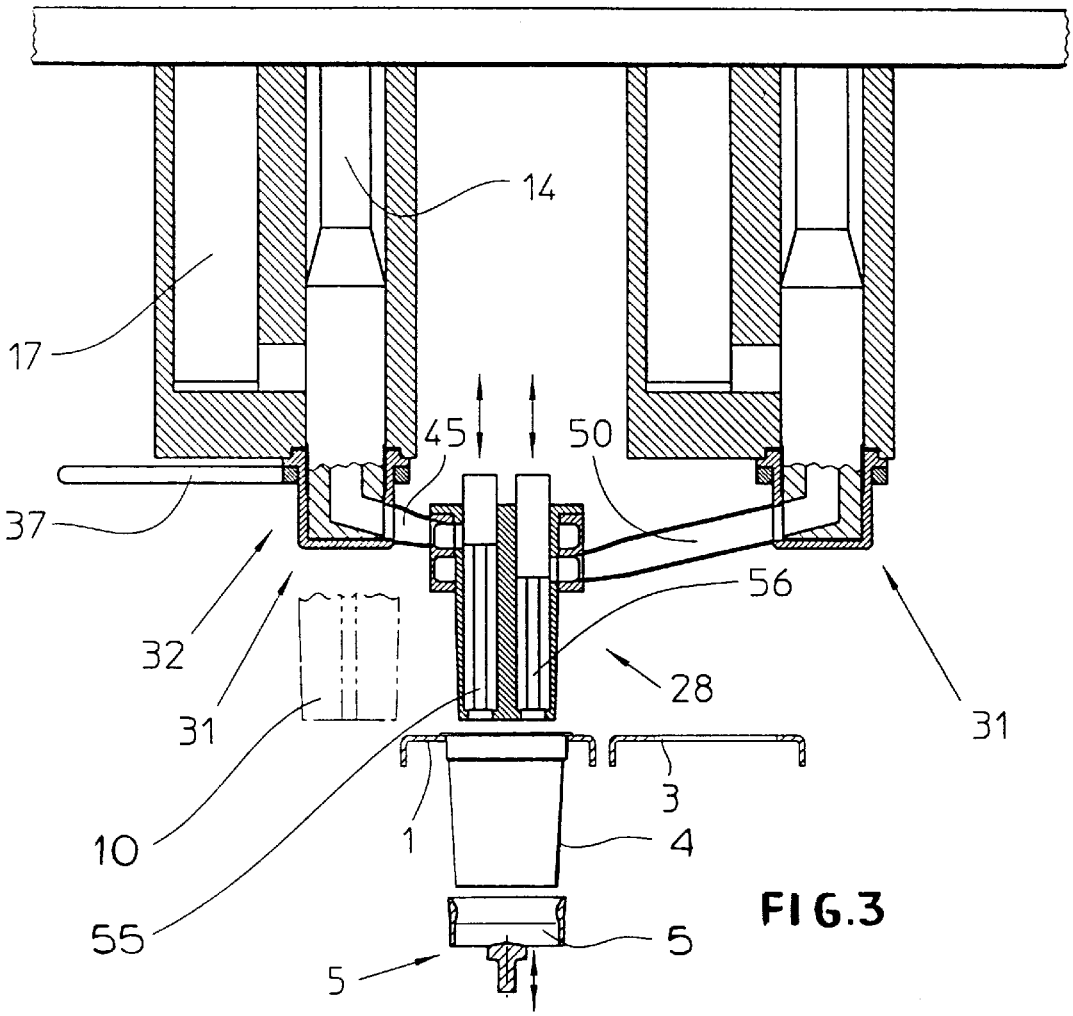
FIG. 3 is a larger-scale view of a detail of FIG. 1.
Figure 4:
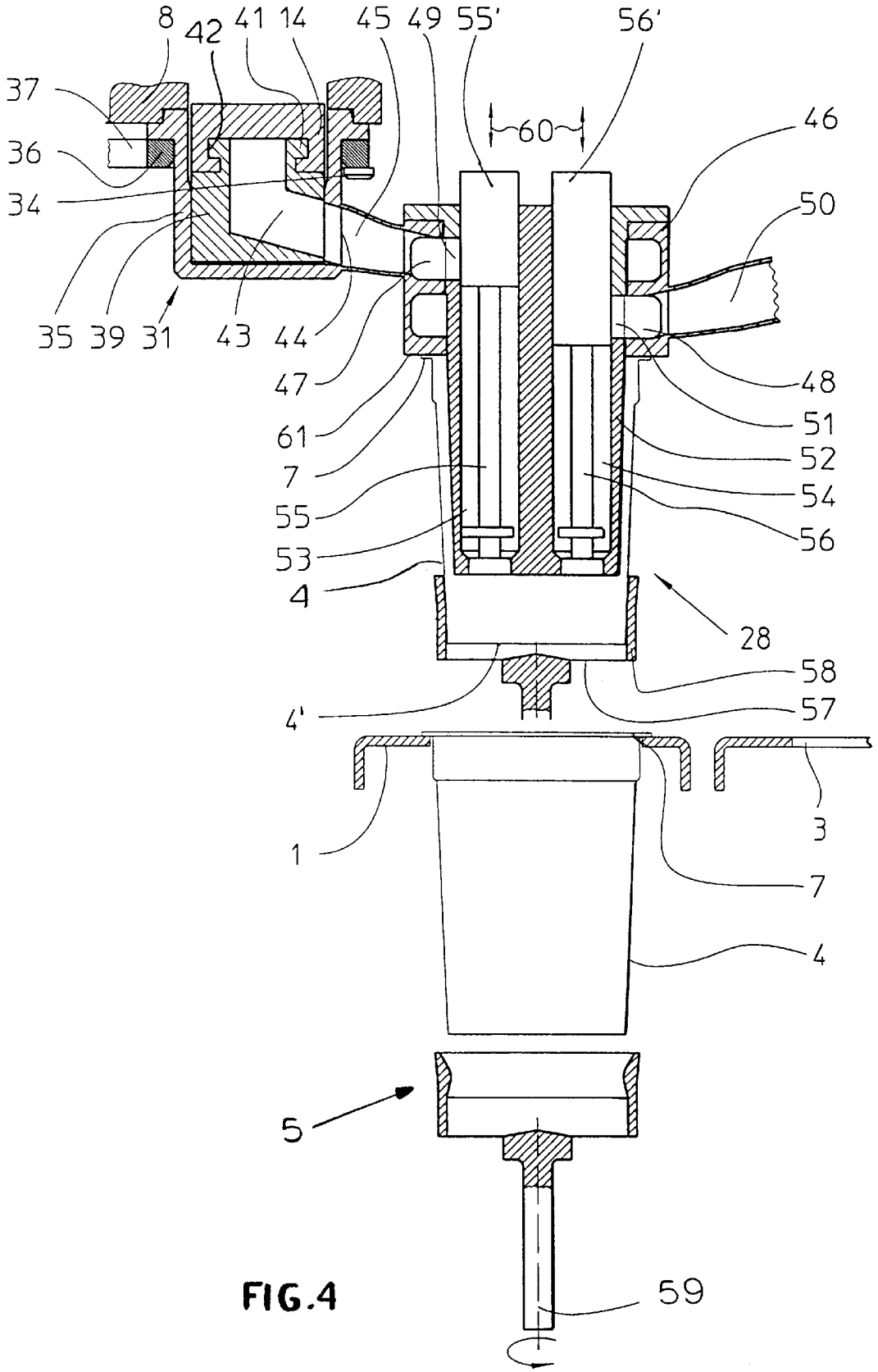
FIG. 4 is a yet larger-scale view of a detail of FIG. 3.

In order, instead of a single-product system, to put different products in different cups 4 or two different products in the same cup 4, a multiple doser 28 is used which is connected via a special manifold arrangement 29 with the two single dosers 8, which to this end have had their single nozzles 10 removed. More particularly as shown in FIGS. 3 and 4, a manifold 31 has connectors 32 that fit over the lower ends of the dosers 8. Each such connector is formed as a cup-shaped housing 35 secured by a ring 36 having a handle 37 to the respective doser 8. This same ring 36 is used to secure the single-passage nozzle 10 in place when it is being used.

Inside the housing 35 is an insert body 39 having a T-shaped flange 41 that fits in a complementary annular recess 42 of the control valve 14 and that is formed with an angled passage 43 opening through an aperture 44 of the housing into a short conduit or tube 45 connected to a distributor body 46 formed with an annular groove 47 into which the tube 45 opens. Another such groove 48 in the body 46 is connected via another such tube 50 of the manifold assembly 29 to receive fluent material from its doser 8. The passages 47 and 48 open via holes 49 and 51 in a housing 52 of the doser 28 into chambers 53 and 54 provided with pistons 55' and 56' carried on rods 55 and 56. The pistons 55' and 56' can be raised and lowered as indicated by the arrows 60 either individually or jointly to allow respective doses of fluent material to flow out of the lower ends of the passages 53 and 54.

Figure 7:
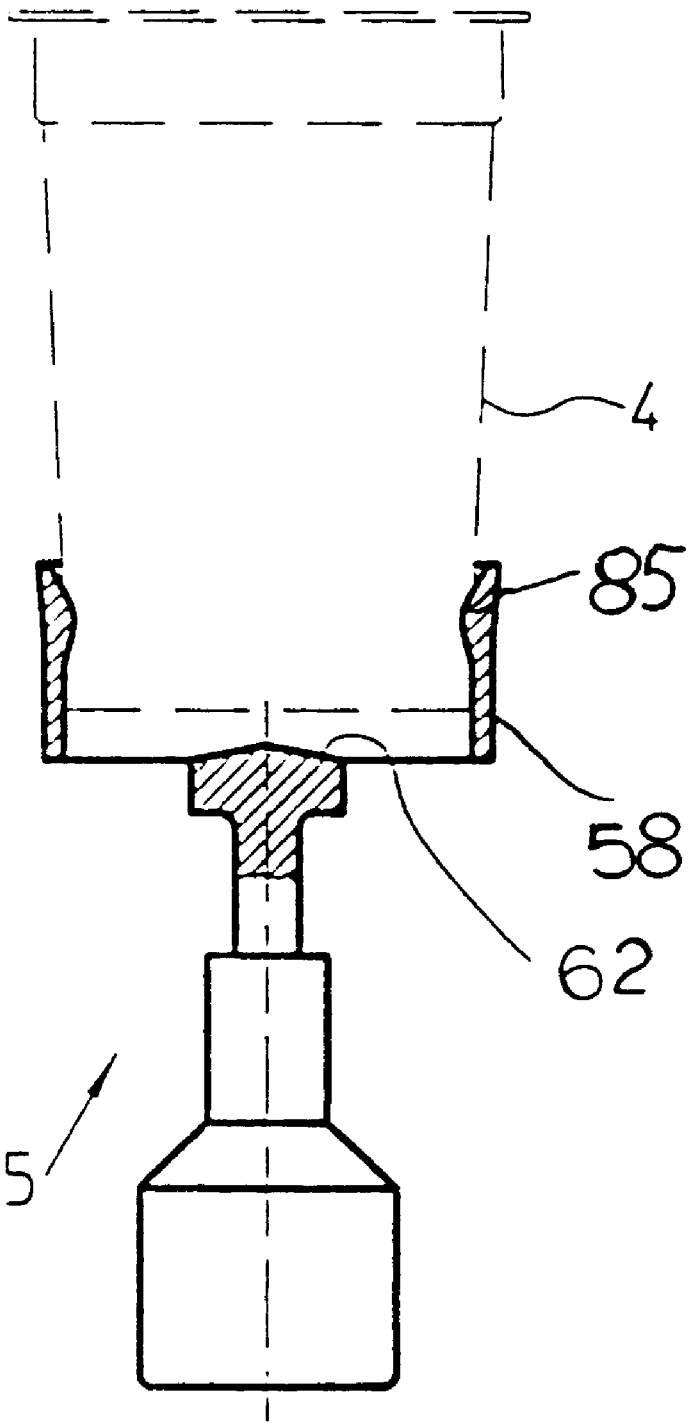
FIG. 7 is a view like a detail of FIG. 6 but showing a variant on the system.

FIG. 4 also shows how the lifter 5 is formed as an upwardly flared stainless-steel ring 58 centered on a vertical axis and connected via a floor 62 having apertures 57 to a lift rod 59 so as to move between the illustrated upper and lower positions. As shown in FIG. 7, instead of the upwardly flared shape, it can have an inwardly directed rounded ridge 85 that grips the cup 4. In the lower position the ring 58 is clear of the bottom of the respective cup 4 hanging in the respective seat 3. When raised it engages around the cup 4 at its base 4' and pushes it up until its rim 7 engages a bottom face 61 of the body 46, thereby seating the cup 4 solidly in the ring 8 and holding it firmly in place. Then the filling operation is commenced as the cup 4 is lowered and rotated. Once the rim 7 engages the seat 3, continued lowering of the lifter 5 pulls the ring 58 off the cup 4.

Figure 6:
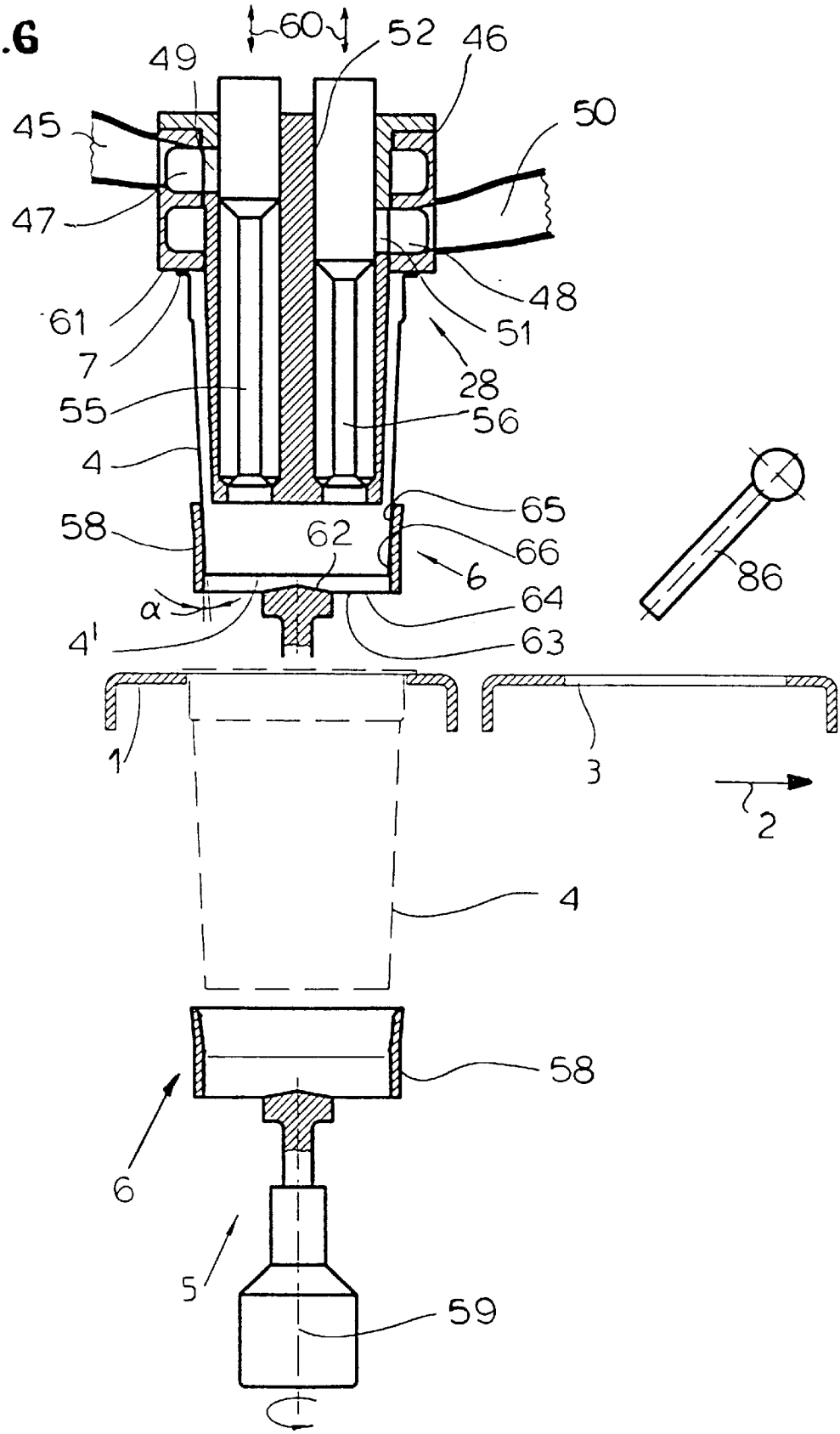
FIG. 6 is a view like FIG. 3 but showing further details of the invention.

More specifically, as shown in FIG. 6, the lifter ring 58 has the centrally raised and downwardly flared floor 62 formed with grooves 63 forming openings 64 through which spilled product can pass. A lower portion 66 of an inner wall of the ring 58 is cylindrical but an upper portion 65 is flared at a slight angle a of a few degrees that allow it to solidly engage and hold the cup 4.

Figure 8:
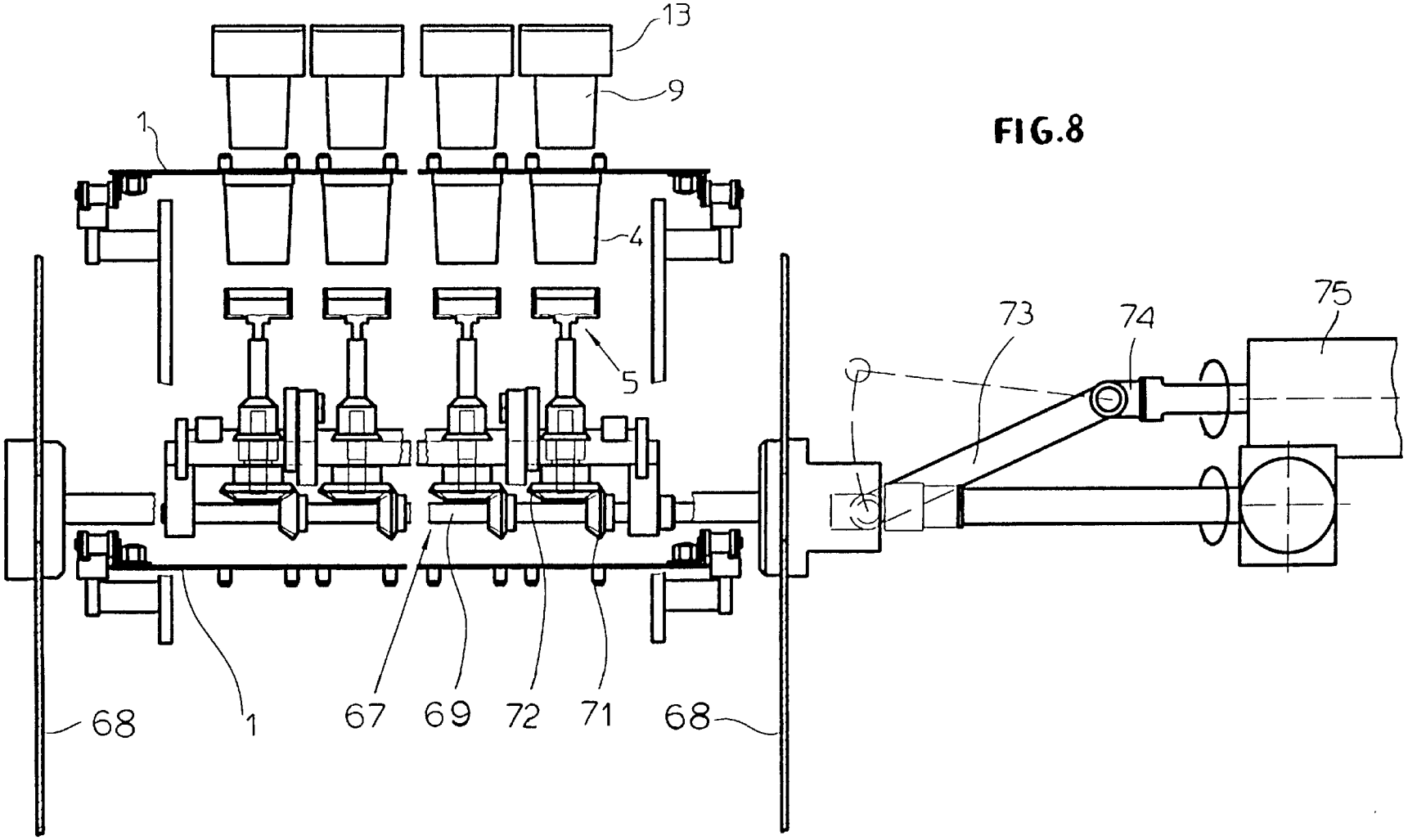
FIGS. 8 and 9 are small-scale partly diagrammatic end and top views illustrating the lifting/rotating system of the apparatus.
Figure 9:
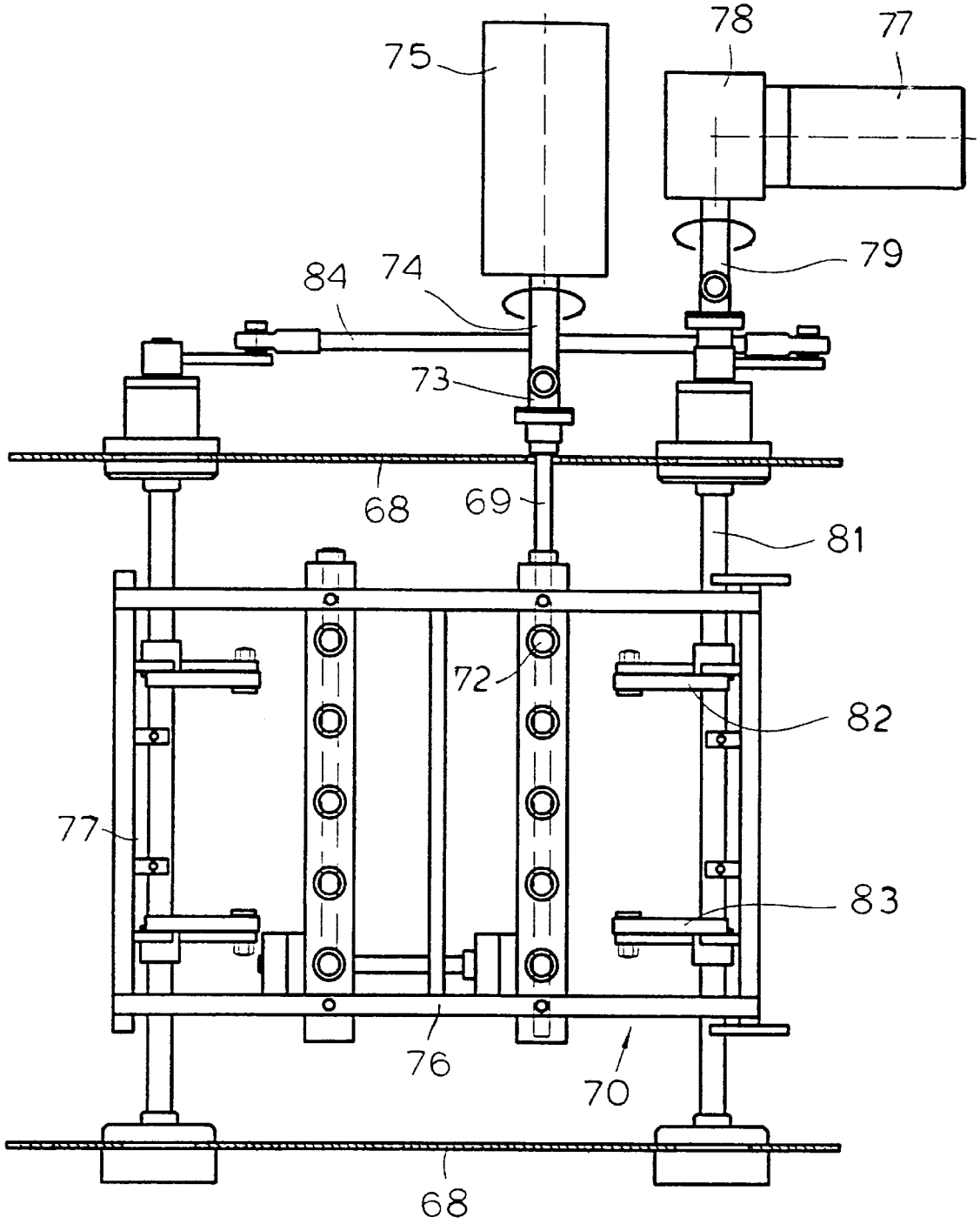

FIG. 8 shows a motor 75 having an output shaft 73, 74 connected to a shaft 69 carrying a plurality of bevel gears 71 meshing with bevel gears 72 rotationally coupled to the shafts 59 for rotating them. FIG. 9 shows another motor 77 connected via a transmission 78 to a shaft 79 journaled in the housing 68 of the machine and carrying a pair of links 82 and 83 that can raise and lower a frame 70 having members 76 and 77 carrying shafts 72 axially coupled to the shafts 59. There are two such shafts 81 interconnected by a link 84 for raising and lowering the frame 70. Thus the motor 75 is responsible for rotating the lifters 5 and the motor 77 for raising and lowering them.

A spray nozzle 86 is provided for washing off the conveyor plates 1 as they pass, and may also be directed at the rotating cup-holding ring 58 to clean it.

By means of a program in the controller 20 it is possible for the system according to the invention to simultaneously operate eight pump drives 11 and valve drives 12 to produce different mixes of product in four different recipients 4, through control of the respective servomotors 24 and 27. Thus it is possible by appropriate formation and arrangement of the passages 47 and 48 and of the respective openings 49 and 51 in the housing 52 of the control body to distribute the product streams to different outlet openings of the doser 28. It is possible in a system with four outlets as shown in FIG. 2 to apply the one product to three of the openings and the other to one opening to make a 3:1 mix. By appropriate rotation of the cups 4 as they are filled the incoming streams can form a spiral or zig zag.

I claim:

1. An apparatus for filling cups, the apparatus comprising:

conveyor means for displacing the cups in a horizontal transport direction stepwise along a horizontal transport path;

at least two dosing units spaced in the transport direction from each other above the path and each including a supply of a fluent material, and valve and pump means for ejecting doses of the material;

a manifold including a pair of intake conduits each extending generally in the horizontal transport direction and each connected to a respective one of the dosing units for receiving the material doses therefrom, a distributor body between the dosing units, formed with a pair of grooves each connected to a respective one of the tubes, and forming a pair of outlet passages open vertically downward toward the path, whereby material fed generally horizontally from the dosing units to the body issues downward from the body;

a lifter below the path, underneath the body, and displaceable between a lower position clear of the cups and an upper position raising a one of the cups into engagement with the body; and means for rotating the lifter and the cup held thereby as the material issues from the body.

2. The cup-filling apparatus defined in claim 1 wherein each intake conduit has an upwardly open cup-shaped intake end fitting complementarily over the respective dosing unit and provided with a connecting rim, and an insert in the intake end formed with a passage communicating with the respective dosing unit, the tubes extending from the intake end and communicating with the passage of the insert, the dosing unit and rim having releasable interengaging formations.

3. The cup-filling apparatus defined in claim 2 wherein each tube extends horizontally and downward from the respective dosing unit to the distributor body.

4. The cup-filling apparatus defined in claim 1 wherein the grooves are circumferential and vertically offset from each other, the outlet passages running vertically downward from the respective grooves, each manifold further including respective pistons displaceable in the passages between positions blocking the passages and positions permitting flow through the passages.

5. The cup-filling apparatus defined in claim 4 wherein the pistons have stems projecting vertically out of the distributor body.

6. The cup-filling apparatus defined in claim 5 wherein the pistons have lower ends sealingly engageable with the respective passages.

7. The cup-filling apparatus defined in claim 1 wherein each dosing unit includes a respective servomotor controlling the respective valve and pump means, the apparatus further comprising central control means connected to all the servomotors for controlling all the servomotors.

8. An apparatus for filling cups, the apparatus comprising:

conveyor means for displacing the cups in a horizontal transport direction stepwise along a horizontal transport path;

at least two dosing units spaced in the transport direction from each other above the path and each including a supply of a fluent material, and valve and pump means for ejecting doses of the material; and a lifter ring below the path, underneath the body, and displaceable between a lower position clear of the cups and an upper position raising a one of the cups into engagement with the body, the lifter ring being shaped complementary to the cup.

9. The cup-filling apparatus defined in claim 8 wherein the lifter ring has a centrally raised floor.

10. The cup-filling apparatus defined in claim 8 wherein the ring is formed with an inwardly projecting annular bead.

11. The cup-filling apparatus defined in claim 8 wherein the ring has a frustoconical upwardly flared upper portion forming a very small angle with the cup.

12. The cup-filling apparatus defined in claim 8, further comprising means for rotating the lifter ring and the cup held thereby as the material issues from the body.

13. A method of filling cups, the method comprising the steps of:

positioning each of the cups in a respective seat in a conveyor plate;

conveying the plates with the cups in a horizontal transport direction stepwise along a horizontal transport path underneath a dosing unit and above a holder;

raising the holder each time a cup arrives below the dosing unit while engaging the holder around the cup to lift the cup and press it upward against the dosing unit and force it downward into the holder;

when a cup has been raised up against the dosing unit, ejecting a dose of a fluent material downward from the dosing unit into the raised cup; and after ejection of the dose into the cup, lowering the holder below the transport plate and thereby stripping the cup from the holder and leaving the lowered cup in the seat of the transport plate.

14. The cup-filling method defined in claim 13 wherein the cup has a resiliently deformable wall, the holder being engaged with the wall.

15. The cup-filling method defined in claim 13, further comprising the step of rotating the holder and the cup held thereby during ejection of the material into the cup.

* * * * *